US006276902B1

(12) United States Patent
Charron

(10) Patent No.: US 6,276,902 B1
(45) Date of Patent: Aug. 21, 2001

(54) SYSTEM COMPRISING A SINGLE-PHASE COMPRESSION UNIT ASSOCIATED WITH A MULTIPHASE COMPRESSION UNIT

(75) Inventor: Yves Charron, Gabriel Faure (FR)

(73) Assignee: Institut Francais du Petrole, Rueil-Malmaison cedex (FR)

( * ) Notice: Subject to any disclaimer, the term of this patent is extended or adjusted under 35 U.S.C. 154(b) by 0 days.

(21) Appl. No.: 09/492,527

(22) Filed: Jan. 27, 2000

(30) Foreign Application Priority Data

Jan. 26, 1999 (FR) ..... 99 00853

(51) Int. Cl.[7] ..... F04B 19/24; F04B 3/00; F04F 19/24

(52) U.S. Cl. ..... 417/53; 417/54; 417/244

(58) Field of Search ..... 417/53, 313, 244, 417/245, 54; 415/116

(56) References Cited

U.S. PATENT DOCUMENTS

| | | | | |
|---|---|---|---|---|
| 4,325,712 | | 4/1982 | Arnaudeau | 137/13 |
| 4,653,268 | * | 3/1987 | Nakamura et al. | 60/39.05 |
| 5,290,151 | * | 3/1994 | Orlando | 417/54 |
| 5,377,714 | | 1/1995 | Giannesini | 137/2 |
| 6,142,743 | * | 11/2000 | Charron | 417/53 |
| 6,171,074 | * | 1/2001 | Charron | 417/313 |
| 6,174,440 | * | 1/2001 | Charron et al. | 210/634 |

FOREIGN PATENT DOCUMENTS

| | | | |
|---|---|---|---|
| 2424472 | 11/1979 | (FR) . | |
| 2424473 | 11/1979 | (FR) . | |
| 2239676 * | 7/1991 | (GB) | F04D/31/00 |
| 2312929 * | 11/1997 | (GB) | F04D/1/02 |

* cited by examiner

*Primary Examiner*—Timothy S. Thorpe
*Assistant Examiner*—Michael K. Gray
(74) *Attorney, Agent, or Firm*—Antonelli, Terry, Stout & Kraus, LLP

(57) ABSTRACT

A system for compressing one or more fluids ($F_1$, $F_2$) with one of the fluids being essentially gaseous. A single-phase compression unit (20) is fed gaseous fluid ($F_1$) from a delivery line (21). A multiphase compression unit (24) receives both fluids ($F_1$, $F_2$). A delivery line (22) delivers gaseous fluid to the multiphase compression unit and a delivery line (23) feeds the other fluid $F_2$ to the multiphase compression unit (24). A discharge line connects to the multiphase compression unit. The single phase compression unit allows operation of the multiphase compression unit within a two-phase efficiency range.

8 Claims, 2 Drawing Sheets

SYSTEM COMPRISING A SINGLE-PHASE COMPRESSION UNIT ASSOCIATED WITH A MULTIPHASE COMPRESSION UNIT

FIELD OF THE INVENTION

The present invention relates to a compression system comprising at least one single-phase compression unit and at least one multiphase compression unit.

The invention is for example intended for fluids $F_1$ and $F_2$, one of the fluids, $F_1$, being essentially gaseous, and another fluid, $F_2$, essentially liquid or multiphase, the total volume flow rate of these two fluids $Qt=Q_{F1}+Q_{F2}$ exceeding notably the treating capacity of the multiphase compression unit.

In the description hereafter, what is referred to as a single-phase or multiphase compression unit is an assembly comprising one or more bodies, each body comprising one or more sections, each section comprising one or more stages.

Similarly, the term "water" refers to fresh water or salt water, such as seawater or formation water.

The multiphase compression unit can comprise single-phase pumping sections and multiphase compression sections.

The system according to the invention can be used for compression of fluids for which the value of the ratio of the volume flow rate of the gas phase to the volume flow rate of the liquid phase (GLR for short) is greater than a limiting value ensuring good two-phase efficiency of the multiphase compression unit (the ratio being considered at the inlet).

The invention can also be used for a mixture of fluids comprising a very large quantity of gas in relation to the quantity of liquid, and when the density of this mixture is too low to obtain sufficient compression ratios in a multiphase compression unit.

BACKGROUND OF THE INVENTION

The prior art describes various devices for compressing a gas phase and for pumping a liquid phase, or for compressing a gas phase and a multiphase phase.

One procedure consists in using suitable single-phase equipments for each phase, associated with phase separation devices.

Single-phase compression of a gas and pumping of a liquid at high pressure generally requires a large number of equipments, for example one or more compressors for compression of the gas, one or more heat exchangers for cooling the gas after compression, one or more pumps for pressure rise of the liquid, one or more devices for mixing the phases, a gas and liquid separator placed upstream from each compression section, pipe connections, valves, instrumentation and a complex regulating system for keeping the assembly in good working order. Such a system is relatively unwieldy and expensive.

It is also well-known to compress a fluid comprising a gas phase and a liquid phase in order to mix them at high pressure, by means of a positive-displacement or rotodynamic type multiphase compression device equipped with helical axial flow impellers. The major drawback of positive-displacement machines is that they are heavy and bulky.

SUMMARY OF THE INVENTION

The layout of the compression system according to the invention consists in judiciously and suitably associating at least one single-phase compression unit situated for example upstream from at least one multiphase compression unit.

One or more integrated mixing and cooling sections can also be associated in the system.

The invention relates to a system for compressing one or more fluids ($F_1$, $F_2$), at least one of the fluids, $F_1$, being essentially gaseous. The system is characterized in that it comprises in combination:

- at least one single-phase compression unit for fluid $F_1$, said unit being connected to a supply line delivering an essentially gaseous fluid,
- at least one multiphase compression unit for both fluids $F_1$ and $F_2$, said multiphase compression unit comprising at least one supply line delivering the essentially gaseous compressed fluid $F_1$ and at least one supply line delivering fluid $F_2$, a fluid discharge line,
- said single-phase compression unit being placed upstream from said multiphase compression unit,
- said single-phase compression unit is for example so dimensioned that the value of the total flow rate of the fluids $Qt=Q_{Gi}+Q_{Lj}$ is less than or equal to the value of the flow rate Qham acceptable by the multiphase compression section in the multiphase compression unit, with
- $Q_{Gi}$ the value of the volume flow rate of the gas phase considered before the inlet of the multiphase compression section, and
- $Q_{Lj}$ the value of the volume flow rate of the liquid phase considered before the inlet of the multiphase compression section.

The single-phase compression unit can be suited to allow operation of the multiphase compression unit within a given two-phase efficiency range.

It can comprise a device for mixing at least part of compressed fluid $F_1$ and of fluid $F_2$ upstream from the multiphase compression unit, fluid $F_2$ being used for cooling fluid $F_1$ compressed in the single-phase compression unit.

It comprises for example at least one means allowing to cool the compressed gas by means of an auxiliary fluid.

The invention also relates to a method for compressing several fluids $F_1$ and $F_2$, at least one of the fluids, $F_1$, being essentially gaseous. The method is characterized in that it comprises in combination at least the following stages:

a) sending essentially gaseous fluid $F_1$ to a single-phase compression unit, and b) sending compressed fluid $F_1$ and fluid $F_2$ to a multiphase compression unit, c) compressing for example the essentially gaseous fluid so as to obtain a total volume flow rate value $Q_{Gi}+Q_{Lj}$ that is less than a flow rate value Qham acceptable by the multiphase compression unit.

The gas phase is for example mixed at least partly with the liquid phase before stage b) by using fluid $F_2$ in order to cool essentially gaseous fluid $F_1$.

The system and the method according to the invention are applied for compression of soluble gas(es) and of their liquid solvent, the total volume flow rate of these two fluids exceeding the capacities of the two-phase compression unit, or for compression of acid gases and water, the total volume flow rate of these two fluids exceeding the capacities of the two-phase compression unit.

The compression system according to the invention notably affords the following advantages:

- the number of parallel-connected multiphase compression sections required for treating fluids having a high total volume flow rate is reduced, the number of series-connected multiphase compression sections required for treating fluids having too low a density is reduced, the number of commonly used single-phase compression and pumping equipments is reduced, maintenance of the assembly is simplified and less expensive, the efficiency is increased in relation to a compression system comprising only two-phase machines.

BRIEF DESCRIPTION OF THE DRAWINGS

Other features and advantages of the invention will be clear from reading the description hereafter, given by way of non limitative examples, with reference to the accompanying drawings wherein.

DETAILED DESCRIPTION OF THE INVENTION

The non limitative example given hereafter illustrates a specific layout according to the invention of a single-phase compression unit and of a multiphase compression unit. Such a compression system is for example used to compress a mixture consisting, for example, of an acid gas (essentially gaseous fluid $F_1$) and of a water (essentially liquid fluid $F_2$) when the value of the total volume flow rate $Qt=Q_{F1}+Q_{F2}$ of these two fluids is greater than the flow rate value Qham acceptable at the inlet of the multiphase compression section of the multiphase compression unit.

In cases where both fluids are fed into the same compression stage of the multiphase compression unit, the total volume flow rate value Qt is taken into account, and when the fluids are introduced at different stages, it is assumed that the volume flow rate of the essentially liquid fluid does not vary much between the stage where it is introduced and the stage where the essentially gaseous fluid is introduced.

Figure 1:
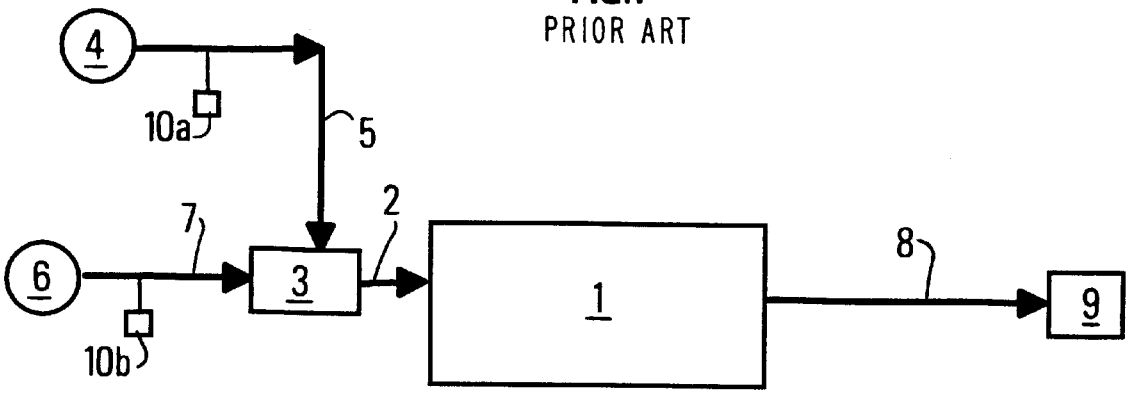
FIG.1 PRIOR ART
FIG. 1 shows a layout used in the prior art for simultaneously imparting energy to a soluble gas and to its liquid solvent, FIG. 2 diagrammatically shows an example of layout of the various single-phase and multiphase compression units according to the invention.

FIG. 1 diagrammatically represents a procedure according to the prior art for imparting energy to an acid gas and to water so as to transfer or to reinject them. The compression section comprises a compression device similar for example to the device described in patent application FR-97/14,604 filed by the applicant.

In this variant, the initial pressure levels of the acid gas and of the water are sufficiently close to allow to introduce them directly into a mixer situated upstream from the multiphase unit.

Multiphase pumping or compression unit 1 is connected by a line 2 to a mixer 3 that receives:

through a line 5, the acid gas coming from a source 4 such as a treating unit, through a line 7, the water stored in a tank bearing reference number 6.

Mixer 3 is for example selected to favour at least partial dispersion of the acid gases in the form of bubbles in the water, or at least partial dispersion of the water in the form of droplets in the acid gas.

Multiphase compression unit 1 comprises at least one discharge line 8 intended for an essentially liquid mixture. The pressure level of this liquid at the outlet is sufficient to allow transfer or reinjection thereof into an aquifer or an underground reservoir bearing reference number 9 in the figure.

The compression system can comprise pressure detectors 10*a,* 10*b* respectively placed at the outlet of treating unit 4 and of storage tank 6 in order to know the pressure values of the acid gases and of the water.

The acid gases can come from a treating unit such as that described in patents FR-2,605,241 and FR-2,616,087 filed by the applicant. At the outlet of these treating units using methanol, the acid gases have a pressure that can range between 0.5 and 1.5 MPa and a temperature ranging for example between −40° C. and 0° C. In case of treating units using amines, the pressure value is of the order of 0.1 MPa and the temperature ranges for example between 10 and 40° C.

Figure 2:
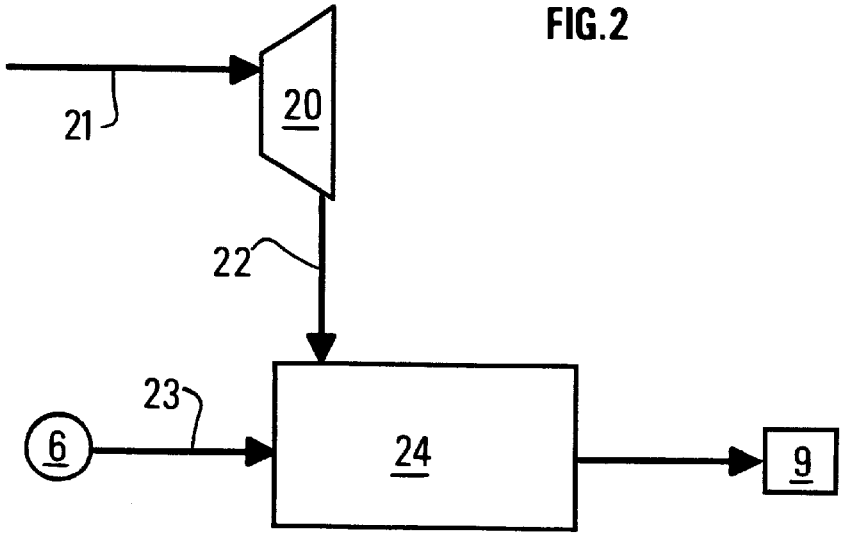
Figure 3:
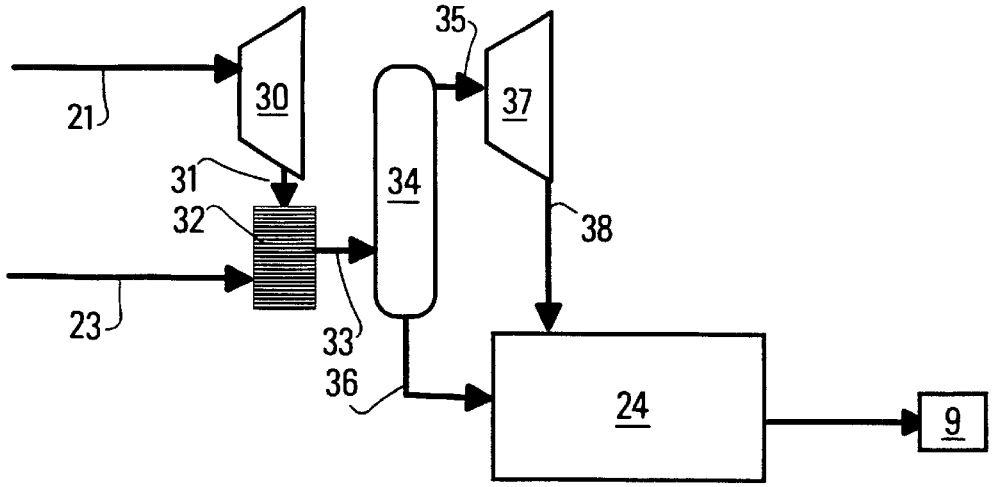
FIG. 3 shows a variant of FIG. 2 comprising an integrated mixing and cooling device.
Figure 4:
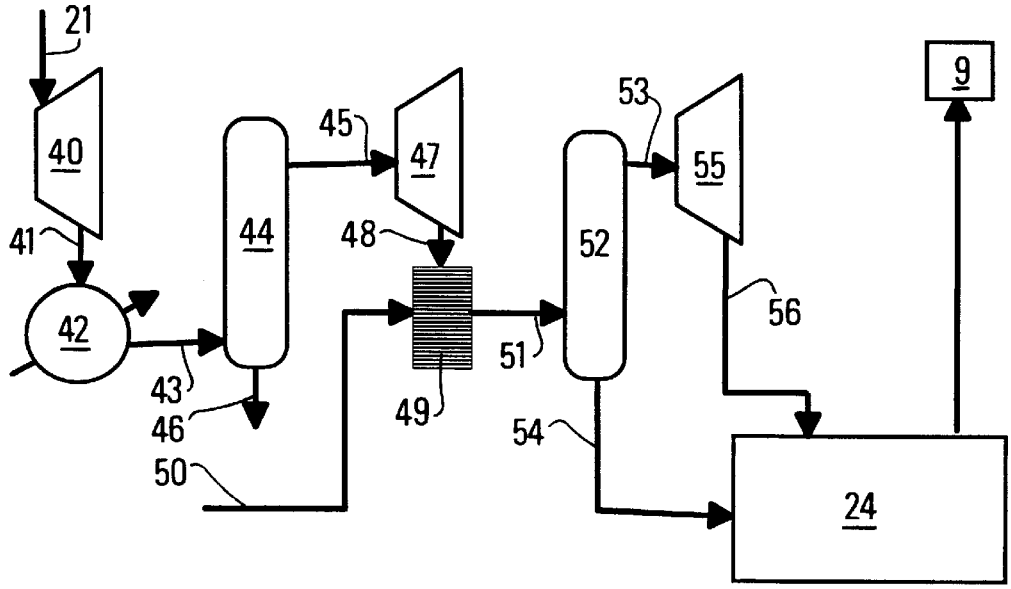
FIG. 4 shows a variant of FIG. 3 comprising a combination of direct and indirect cooling sections.

When the total volume flow rate Qt of the acid gas-water mixture, considered upstream from the multiphase compression unit, is higher than the value Qham acceptable by this unit, it is possible to use one of the layouts described in FIGS. 2 to 4 for example.

FIG. 2 shows a first realization variant of the compression system according to the invention comprising at least one single-phase compression unit placed upstream from a multiphase compression unit. The single-phase compression unit in this example comprises only one single-phase compression section.

The gas is introduced through a line 21 at a pressure $P_{G0}$ and with a volume flow rate $Q_{G0}$ in a compression unit 20 suited to compress it so as to obtain, at the outlet, a gas at a pressure $P_{G1}$ and a volume flow rate $Q_{G1}$. The compressed gas is then sent to multiphase compression unit 24 through a line 22.

The liquid or water is sent from source 6 to multiphase compression unit 24 through a line 23 communicating for example with a pumping section suited for an essentially liquid fluid (not shown in the figure for clarity reasons). The liquid is at a pressure level $P_{L1}$ and its volume flow rate is $Q_{L1}$.

The fluid at the outlet of multiphase compression unit 24 has a flow rate $Q_{G2}$, a pressure $P_{G2}$ and a temperature $T_{G2}$.

Dimensioning of the single-phase compression unit is selected so as to meet relation (1):

$$Qt=Q_{G1}+Q_{L1}\leq Qham \quad (1),$$

with Qt=total flow rate of the compressed gas and of the liquid considered at the inlet of the multiphase compression unit, and Qham corresponds to the value of the total volume flow rate of fluid acceptable at the inlet of the multiphase compression unit.

Selection of the Single-phase Compression Unit and of the Flow Rates of Each Fluid In general, a single-phase compression unit comprises for example one or more single-phase compression sections whose characteristics are selected by taking account, for example, of relation (1) involving the quantity of liquid, and of the solubility condition that is possibly to be met at the outlet of the multiphase compression unit.

In the case of FIG. 2, where the single-phase compression unit comprises only one compression section, the characteristics or dimensions of this single-phase compression section can be determined according to one of the methods explained hereafter:

Characteristics of the single-phase compression section without solubility condition, the fluid can be a multiphase fluid at the outlet of the multiphase compression unit.

The characteristics of the section are selected so as to meet relation (1). The value of the volume flow rate of liquid, measured for example by means of a flowmeter placed on line 23, is known.

Two cases can then be considered:

a) The value of $Q_{G0}$ is known or determined:

The minimum compression ratio allowing to obtain value $Q_{G1}$, meeting relation (1) in the extreme case (maximum flow rate), is deduced therefrom.

If the compression ratio of the single-phase compression unit is higher than an allowable maximum value, determined from criteria known to the man skilled in the art, using at least one additional compression section can be considered, which corresponds to the instance described in FIG. 3.

b) The value of $Q_{G0}$ remains to be determined:

Value $Q_{G1}$ is determined from Qham and $Q_{L1}$. The allowable maximum compression ratio of the single-phase compression unit is known.

The maximum value allowing to obtain value $Q_{G0}$, meeting relation (1) in the extreme case, is deduced therefrom.

Characteristics of the single-phase compression unit with solubility condition.

The fluid is essentially liquid at the outlet of the multiphase compression unit.

The single-phase and multiphase compression units are selected so as to meet relation (1) and relation (2) defined as follows:

$$[Q_{Gs}(P_{Gs}, T_{Gs})/Q_{Le}] \leqq K(P_{Gs}, T_{Gs}) \quad (2)$$

with:

$Q_{Gs}$ flow rate of the gas at the outlet, $P_{Gs}$ pressure of the gas at the outlet, $T_{Gs}$ temperature of the gas at the outlet, $Q_{Le}$ liquid flow rate, K dissolution factor at $P_{Gs}$ and $T_{Gs}$, e and s respectively denoting the inlet and the outlet of the multiphase section; in the case of this figure, e and s correspond to indices 1 and 2.

Solving relations (1) and (2) by equating the right-hand member to the left-hand member allows to obtain the following value:

$$Q_{Ll} = \frac{Qham * (P_{Ge}/P_{Gs}) * (T_{Gs}/T_{Ge})}{K + (P_{Ge}/P_{Gs}) * (T_{Gs}/T_{Ge})} \quad (3)$$

with Qham: value of the total volume flow rate of fluid acceptable at the inlet of the two-phase compression unit and $$Q_{G0} = Q_{Ge} * (P_{Ge}/P_{G0}) * (T_{G0} T_{Ge}) \quad (4)$$

with $T_{G0}$: temperature of the gas at the inlet of the single-phase compression unit.

For example, for a given reinjection pressure $P_{Gs}$, a given gas composition, a given Qham value, the whole system is defined by taking account of a given additional parameter, selected for example from one of the following four values: $P_{Ge}$, $Q_{Ge}$, $Q_{G0}$, $Q_{Le}$.

Supposing for example that $Q_{Le}$ is a production datum, $P_{Ge}$ is defined by relation (3), $Q_{Ge}$ by relation (1) and $Q_{G0}$ by relation (4).

The multiphase compression unit comprises for example, within a single casing, a single-phase pumping section followed by a multiphase compression section comprising several multiphase compression cells having for example the characteristics of the devices described in patent application FR-97/14,604 filed by the applicant, notably in FIGS. 4A to 7.

The pumping or compression cells, known to the man skilled in the art, are for example helical axial flow or radial flow type cells. For helical axial flow cells, it is possible to use cells similar to those described in FIG. 4A of the aforementioned patent application.

At the level of the multiphase compression unit, the liquid is introduced at a pressure level $P_{L1}$ and at a volume flow rate $Q_{L1}$ for example at the inlet of the first stage of a single-phase pumping section.

In parallel, the compressed gas is immediately introduced downstream from the single-phase pumping section and in the multiphase compression unit at a pressure level $P_{G1}$ and at a volume flow rate $Q_{G1}$ It can be introduced through an adaptation stage as described in FIG. 7 of the aforementioned patent application.

The purpose of the adaptation stage is notably to mix the gas and the liquid, and to cool the gas heated during compression from $P_{G0}$ to $P_{G1}$. Cooling is performed by means of the liquid circulating through the multiphase compression unit.

FIG. 3 shows a realization variant of FIG. 2 comprising a device for mixing the essentially gaseous compressed fluid $F_1$ with fluid $F_2$.

In this example, the single-phase compression unit comprises a low-pressure single-phase compression section 30 and a high-pressure single-phase compression section 37.

Applied to the example given in FIG. 2, liquid $F_2$ is used in the mixer to cool compressed gas $F_1$ whose temperature has risen as a result of compression.

The compression system comprises:

low-pressure single-phase compression section 30 connected to gas delivery line 21 and to compressed gas discharge line 31, a device 32 suited to mix the compressed gas and fluid $F_2$, water in the present case. Mixing device 32 is connected to water delivery line 23 and to compressed gas discharge line 31. The gas is partly dissolved in the water and at least partly cooled thereby, a discharge line 33 for a mixture $M_1$ consisting of the liquid containing the dissolved gas and the gas that has not dissolved in mixer 32, the discharge line being connected to a separation device such as a separating drum 34, the separating drum is provided, in the upper part thereof, with a discharge line 35 intended for the gas that has not dissolved in the water and, in the lower part thereof, with an extraction line 36 intended for a mixture consisting of the liquid containing the dissolved gas fraction, line 35 is connected to high-pressure single-phase compression section 37 that can be similar to the compression device described in FIG. 2, and line 36 is connected to the multiphase compression unit, the gas compressed through high-pressure section 37 is sent through a line 38, according to the same path as shown in FIG. 2, to the multiphase compression unit.

The multiphase compression unit can be similar to that previously described in FIG. 2.

Implementation of such a layout can be performed as follows:

The gas (with a flow rate $Q_{G0}$, $P_{G0}$, $T_0$) is compressed to a pressure level $P_{G1}$ through single-phase compression section 30 prior to being sent to mixer 32 through line 31. It is then at a temperature $T_1$ higher than its initial temperature $T_0$ before compression.

In mixer 32, it is at least partly dissolved in the water and cooled by heat exchange therewith.

Mixture $M_1$ consisting of the gas fraction dissolved in the water and of the non-dissolved gas is thereafter separated in separating drum 34 so as to produce a gas fraction sent to be compressed through compression section 37 to a pressure level $P_{G2}$ selected to obtain a volume flow rate $Q_{G2}$ so that relation (1) is met. The compressed gas fraction is fed into the multiphase compression section through a line 38.

The liquid fraction of the mixture separated in drum 34 is sent through a line 36 at a volume flow rate $Q_{L2}$, measured for example by means of a flowmeter situated between separator 34 and the inlet of the multiphase compression unit.

The technical features of the compressor or of all of the single-phase compressors that constitute compression unit 30, 37 are selected according to the method described above with the condition $Q_{G2}+Q_{L2} \leqq Qham$, with $Q_{G2}$ the volume flow rate of the compressed gas at the outlet of the high-pressure compression section upstream from the multiphase compression unit, and $Q_{L2}$ the volume flow rate of liquid fraction $L_2$ at the inlet of the single-phase pumping section.

Determination of the Characteristics of the Compression Sections

The liquid flow rate $Q_{L2}$ being known, two cases can be considered:

The value of $Q_{G0}$ is known:

The minimum compression ratio of each single-phase compression section allowing to obtain value $Q_{G2}$ meeting relation (1) in the extreme case (maximum flow rate) is deduced therefrom. If these compression ratios are higher than an allowable maximum value determined from criteria known to the man skilled in the art, using an additional single-phase compression section corresponding, for example, to the layout described in FIG. 4 is considered.

The value of $Q_{G0}$ is unknown:

The allowable maximum compression ratio of each single-phase compression section is known.

The maximum value of $Q_{G0}$ allowing to obtain value $Q_{G2}$ meeting relation (1) in the extreme case is deduced therefrom.

FIG. 4 diagrammatically shows a realization variant of FIG. 3 comprising a first single-phase compression section with cooling without mixing with the liquid, followed by one or more single-phase compression sections.

First single-phase compression section 40 is connected by a line 41 to a cooling device 42 itself connected by a line 43 to a separation device such as a separating drum 44. Drum 44 is provided, in the upper part thereof, with a discharge line 45 for sending a gas phase to single-phase compression section 47 and, in the lower part thereof, with a discharge line 46 possibly intended for a condensed liquid phase.

The gas is introduced through line 21 into compression section 40 where it is compressed to a pressure value $P_{G1}$. The compressed gas having a volume flow rate $Q_{G1}$ is cooled in cooling device 42 by using for example an auxiliary fluid external to the compression system. At the outlet of this device, it comes in the form of a two-phase fluid comprising a gas fraction and a liquid fraction. These two fractions are separated in separating drum 44, the gas fraction having a volume flow rate $Q'_{G1}$ and a pressure $P_{G1}$ is sent to single-phase compression section 47 where it is compressed to a pressure value $P_{G2}$. At the outlet of this section 47, the gas has a volume flow rate $Q_{G2}$ and a temperature $T_2$ higher than initial temperature $T_0$ as a result of compression. The gas is then sent through a line 48 in order to be at least partly dissolved and cooled in device 49 according to a pattern substantially similar to that described in FIG. 3 (device 32), by using the water introduced through line 50. A mixture of liquid and non-dissolved gas is obtained after cooling and sent through a line 51 to a separating drum 52.

The gas fraction separated in separating drum 52 is sent to compression section 55 where it is compressed to a pressure value $P_{G3}$ and its volume flow rate is $Q_{G3}$ at the outlet. It is introduced for example by means of line 56 into multiphase compression unit 24.

The liquid fraction separated in drum 52 is introduced through a line 54 into the multiphase compression unit, for example in the vicinity of a single-phase pumping section forming the inlet of multiphase compression unit 24.

The characteristics of compression sections 40, 47 and 55 are selected so as to meet relation (1) by taking account of volume flow rate $Q_{G3}$ of the gas fraction at the outlet of single-phase compression section 55 and of volume flow rate $Q_{L3}$ of the liquid fraction extracted through line 54.

Liquid flow rate $Q_{L3}$ being known, two cases can then be considered:

The value of $Q_{G0}$ is known: the minimum compression ratio of each single-phase compression section allowing to obtain value $Q_{G3}$, meeting relation (1) in the extreme case (maximum flow rate), is deduced therefrom. If these compression ratios are higher than an allowable maximum value, determined from criteria known to the man skilled in the art, using an additional single-phase compression section corresponding, for example, to the layout described in FIG. 4 will be considered.

The value of $Q_{G0}$ is unknown: $Q_{L3}$ is determined by means of $Q_{L1}$ and of Qham, the allowable maximum compression ratio of each single-phase compression section is known. The maximum value of $Q_{G0}$ allowing to obtain value $Q_{G3}$ meeting relation (1) in the extreme case is deduced therefrom.

Various numerical instances are given hereafter by way of non limitative example in connection with FIGS. 2 to 4.

Case 1—FIG. 2: This case relates to a specific application, according to the invention, of the layout of a gas compression section and of a multiphase compression unit comprising a pumping section and a multiphase compression section for compression of a mixture consisting of acid gas and water, the acid gas itself consisting of a mixture of carbon dioxide and of hydrogen sulfide.

The liquid is introduced with a volume flow rate $Q_{L1}$ of 120 $m^3$/hr and the gas with a volume flow rate $Q_{G0}$ of 4000 $Nm^3$/hr. At the outlet of the single-phase compression section, the volume flow rate $Q_{G1}$ of the gas is of the order of 2300 $m^3$/hr at a pressure of the order of 0.33 MPa abs.

These values notably depend on the composition of the gas ($H_2S$ and $CO_2$ fractions). They correspond to a solubility ratio of the order of 34 $Nm^3$ acid gas per $m^3$ water at a pressure of the order of 7.5 MPa abs at the outlet of the multiphase compression unit.

Case 2—FIG. 3: This case relates to a specific application, according to the invention, of the layout of two gas compression sections and of a multiphase compression unit comprising a pumping section and a multiphase compression section for compression of a mixture consisting of acid gas and water.

The liquid is introduced at a volume flow rate $Q_{L1}$ of 360 $m^3$/hr and the gas at a volume flow rate $Q_{G0}$ of 13,000 $Nm^3$/hr. At the outlet of the single-phase compression unit, the volume flow rate $Q_{G2}$ of the gas is of the order of 2000 $m^3$/hr at a pressure of the order of 0.9 MPa abs.

These values notably depend on the composition of the gas ($H_2S$ and $CO_2$ fractions). They correspond to a solubility ratio of the order of 37 $Nm^3$ acid gas per $m^3$ water at a pressure of the order of 10.5 MPa abs at the outlet of the multiphase compression unit.

Case 3—FIG. 4: This case relates to a specific application, according to the invention, of the layout of three gas compression sections and of a multiphase compression unit comprising a pumping section and a multiphase compression section for compression of a mixture consisting of acid gas and water.

The liquid is introduced at a volume flow rate $Q_{L1}$ of 850 $m^3$/hr and the gas at at volume flow rate $Q_{G0}$ of 33,000 $Nm^3$/hr. At the outlet of the single-phase compression unit, the volume flow rate $Q_{G3}$ of the gas is of the order of 1600 $m^3$/hr at a pressure of the order of 2.7 MPa abs.

These values notably depend on the composition of the gas ($H_2S$ and $CO_2$ fractions). They correspond to a solubility ratio of the order of 40 $Nm^3$ acid gas per $m^3$ water at a pressure of the order of $_{15}$ MPa abs at the outlet of the multiphase compression unit.

In all the realization examples given in FIGS. 2 to 4, the multiphase compression unit can comprise two compression sections laid out according to FIGS. 3 and 5 and to the corresponding description in patent application FR-97/14, 604.

The multiphase compression unit can be associated with a treating unit or it can comprise a refrigeration system as described in FIG. 9 of the aforementioned patent application.

According to another realization variant, multiphase compression unit 24 can comprise a means for recycling at least a fraction of the liquid phase extracted at the outlet of the compression device, in the vicinity of the last stage or of one of the last stages. Such a layout can be obtained according to the pattern described in FIGS. 10*a* and 10*b* of the aforementioned patent application.

The multiphase compression unit can be associated with a velocity control means.

It can also comprise measuring means such as temperature detectors or pressure detectors, devices allowing to determine the proportion of gas at the outlet or the density of the mixture at the outlet.

The different variants are for example described in the aforementioned patent application.

For example, the inlet and outlet stages of the multiphase compression unit can be suited for pumping of an essentially liquid fluid at the inlet or at the outlet when the gas has been totally dissolved while passing through the multiphase compression device.

Without departing from the scope of the invention, it is also possible to use such a layout to work in an operating range of the multiphase compression unit for which the two-phase efficiency is optimal or corresponds to a value required by the operator.

A multiphase compression unit can be characterized by multiphase efficiency curves in a diagram (GLR, multiphase efficiency, phase density ratio) where the GLR is the value of the gas-liquid ratio. The GLR value can range between 0 and 1.

The single-phase compression unit is for example so dimensioned that the GLR value at the inlet of the multiphase compression unit allows operation within a two-phase efficiency range D that is optimal or considered satisfactory in relation to the operator's expectations.

Generally speaking, the different realization variants given above are suited for mixtures consisting of acid gases and water such as fresh water, salt water (formation water, seawater).

The invention can also be applied to compress a mixture consisting of an essentially gaseous fluid $F_1$ and a multiphase or two-phase fluid $F_2$.

For example, fluid $F_1$ is an acid gas and fluid $F_2$ a mixture of acid gas and water.

What is claimed is:

1. A system for compressing one or more fluids ($F_1$, $F_2$), at least one of the fluids, $F_1$, being essentially gaseous, characterized in that it comprises in combination:

at least one single-phase compression unit (20) for fluid $F_1$, said unit being connected to a delivery line (21) intended for an essentially gaseous fluid, at least one multiphase compression unit (24) for both fluids $F_1$ and $F_2$, said multiphase compression unit comprising at least one delivery line (22) for essentially gaseous compressed fluid $F_1$ and at least one delivery line (23) for fluid $F_2$, a fluid discharge line, said single-phase compression unit (20) is placed upstream from said multiphase compression unit (24), and said single-phase compression unit is so dimensioned that the total flow rate value of the fluids $Qt=Q_{Gi}+Q_{Lj}$ is less than or equal to flow rate value Qham acceptable by the multiphase compression section in the multiphase compression unit, with $Q_{Gi}$ the volume flow rate value of the gas phase considered before the inlet of the multiphase compression section, and $Q_{Lj}$ the volume flow rate value of the liquid phase considered before the inlet of the multiphase compression section.

2. A compression system as claimed in claim 1, characterized in that said single-phase compression unit is suited to allow operation of the multiphase compression unit within a given two-phase efficiency range.

3. A system as claimed in claim 1, characterized in that it comprises a device (32) for mixing at least part of compressed fluid $F_1$ and fluid $F_2$ upstream from the multiphase compression unit, fluid $F_2$ being used to cool fluid $F_1$ compressed through the single-phase compression unit.

4. A system as claimed in claim 1, characterized in that it comprises at least one means (42) allowing to cool the compressed gas by means of an auxiliary fluid.

5. A method for compressing several fluids $F_1$ and $F_2$, at least one of the fluids $F_1$ being essentially gaseous, characterized in that it comprises in combination at least the following stages:

a) sending essentially gaseous fluid $F_1$ to a single-phase compression unit, b) introducing compressed fluid $F_1$ and fluid $F_2$ into a multiphase compression unit, and c) compressing the essentially gaseous fluid so as to obtain a total volume flow rate value $Q_{Gi}+Q_{Lj}$ less than a flow rate value Qham acceptable by the multiphase compression unit.

6. A method as claimed in claim 5, characterized in that the gas phase is at least partly mixed with the liquid phase before stage b) by using fluid $F_2$ for cooling essentially gaseous fluid $F_1$.

7. A method as claimed in claim 5, wherein the several fluids are soluble gas(es) and their liquid solvent, the total volume flow rate of these two fluids exceeding the capacities of the two-phase compression unit.

8. A method as claimed in claim 5, wherein the several fluids are acid gases and formation water, the total volume flow rate of these two fluids exceeding the capacities of the two-phase compression unit.

* * * * *